United States Patent [19]

Kulesza et al.

[11] 4,280,300

[45] Jul. 28, 1981

[54] TOY VEHICLE

[75] Inventors: Ralph J. Kulesza, Chicago; Harry Disko, South Barrington; James G. Thibault, Chicago, all of Ill.

[73] Assignee: Marvin Glass & Associates, Chicago, Ill.

[21] Appl. No.: 119,808

[22] Filed: Feb. 8, 1980

[51] Int. Cl.[3] ..... A63H 11/10

[52] U.S. Cl. ..... 46/204; 46/201

[58] Field of Search ..... 46/204, 201, 202, 221, 46/206, 205, 230, 251

[56] References Cited

U.S. PATENT DOCUMENTS

| | | | |
|---|---|---|---|
| 2,161,971 | 6/1939 | Muller | 46/206 X |
| 2,551,109 | 5/1951 | Fornary | 46/204 |
| 2,697,305 | 12/1954 | Muller | 46/206 |
| 2,757,482 | 8/1956 | Brown et al. | 46/106 X |
| 3,364,619 | 1/1968 | Van Cleemput | 46/204 |
| 3,387,778 | 6/1968 | Althaus | 46/202 X |
| 3,523,388 | 8/1970 | Glass et al. | 46/204 X |

FOREIGN PATENT DOCUMENTS

| | | | |
|---|---|---|---|
| 833914 | 2/1952 | Fed. Rep. of Germany | 46/201 |
| 2206331 | 2/1980 | United Kingdom | 46/230 |

*Primary Examiner*—G. E. McNeill
*Assistant Examiner*—Mickey Yu
*Attorney, Agent, or Firm*—Mason, Kolehmainen, Rathburn & Wyss

[57] ABSTRACT

A toy vehicle includes a body mounted on a plurality of ground engaging wheels to allow travel across a suitable surface. A speed indicating device is defined on the body and connected to the wheels as is a distance traveled indicating device. A sound producing assembly is mounted within the body in contact with the distance indicating device to produce sounds corresponding to the travel of the vehicle across the surface. The toy vehicle also includes a manually actuated device for indicating the direction in which the vehicle is to be turned similar to a turn signal on an automobile.

11 Claims, 7 Drawing Figures

24
22
78
72
60
12
114
116
118
168
26
32
30
62
20
64
148
16
166
34
143
28
32
18
36
16
14
30

24
22
12
120
103
72
20
148
26
128
158
152
160
86
68
151
102
126
172
156
154
146
14
82
42
78
66
142
76
128
50
74
46
88
70
132
134
54
136
38
27
40

24
22
122
108
105
12
120
26
30
128
168
94
158
160
14
86
92
42
80
50
110
106
46
54
88
38
27
40

TOY VEHICLE

BACKGROUND OF THE INVENTION

1. Field of the Invention

The present invention relates to a new and improved toy vehicle.

2. Brief Description of the Prior Art

Children, as a result of television, motion pictures and radio are acutely aware of machines and devices operated and used by adults. As a result, many children enjoy toys that correspond to machinery and equipment used by their parents. Vehicles such as automobiles, trucks and trains are popular with children. There are many prior art toys which include a body in the form of the vehicle, such as an automobile, mounted on wheels. More than this, however, is often required to entertain a child. For example, a toy simulating an adult vehicle such as an automobile preferably may include several different components that are similar to components on the adult vehicle and may be operated by the child such as, for example, windshield wipers. The more realistic in operation that the various components on the toy vehicle are in comparison to the vehicle used by the parent, the more enjoyable it is to the child. Consequently, it is preferable in toy vehicles to have as many components operable by the child in as realistic a manner as possible.

SUMMARY OF THE INVENTION

An object of the present invention is to provide a new and improved toy vehicle.

Another object of the present invention is to provide a new and improved toy vehicle that is realistic in appearance and operation.

A further object of the present invention is to provide a new and improved toy vehicle that includes a speed indicating device.

A still further object of the present invention is to provide a new and improved toy vehicle that includes a device indicating the distance traveled by the toy vehicle.

Still another object of the present invention is to provide a new and improved toy vehicle that includes repeatedly actuated turn signals.

The present invention is directed to a toy vehicle that includes a body fabricated in the configuration of an automobile and mounted on a plurality of wheels to allow the vehicle to travel over a surface. Mounted on the toy vehicle is a distance indicating device that is coupled to one or more of the wheels to indicate the distance traveled by the vehicle over the surface.

The toy vehicle also includes a speed indicating device that indicates the speed of the vehicle as it travels over the surface. Both the speed indicating and travel indicating devices of the toy vehicle may be connected to a sound producing structure to produce a desired sound upon actuation of the speed and distance indicating devices. The toy vehicle also may include an automatically repeatable turn signal device thereon.

BRIEF DESCRIPTION OF THE DRAWINGS

The above and other objects and advantages and novel features of the present invention will become apparent from the following detailed description of the preferred embodiment of the invention illustrated in the accompanying drawings wherein.

DESCRIPTION OF THE PREFERRED EMBODIMENT

Figure 1:
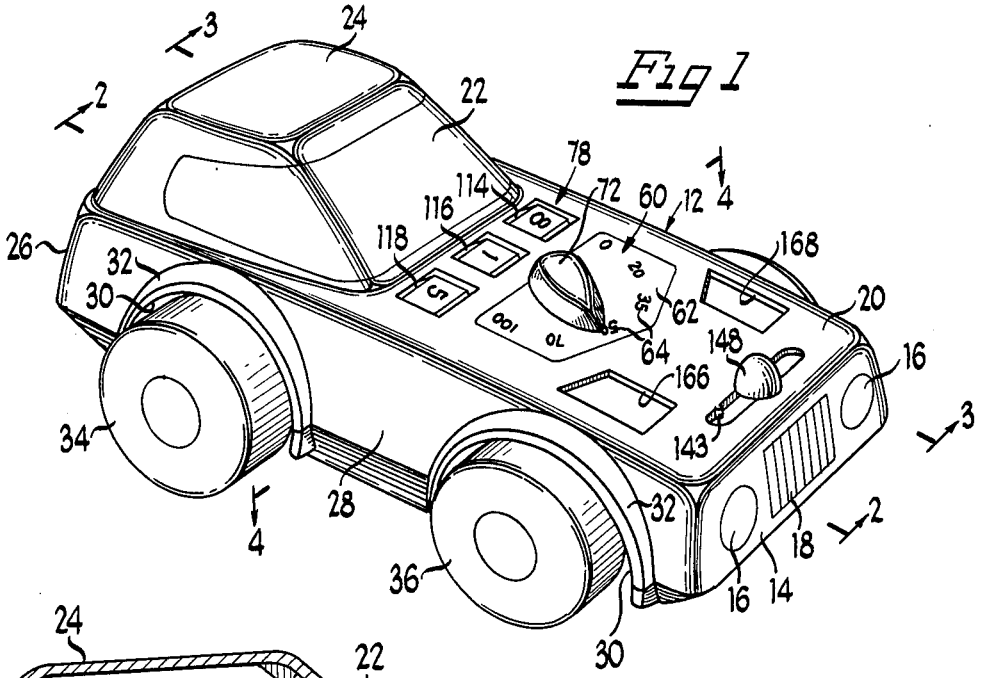
FIG. 1 is a perspective view of the preferred embodiment of the toy vehicle constructed in accordance with the principals of the present invention.

Referring now to the drawings and initially to FIG. 1, there is illustrated a toy vehicle generally designated by the reference numeral 10 that is fabricated in the configuration of an automobile; however, it is to be understood that the toy vehicle 10 of the present invention may be of several different configurations such as a truck, tractor or train. The toy vehicle 10 may be used by a child to be pushed across a surface, such as a floor, and while being pushed, indicates a speed of travel, the distance traveled and a manually actuated signal for indicating turning of the toy vehicle 10.

More specifically, the toy vehicle 10 includes a frame 12 that may be molded in a single piece in the configuration of, in the preferred embodiment illustrated, an automobile. The frame 12 includes a front end 14 molded into the configuration of a front end of an automobile including headlights 16 that may be molded or painted thereon or by any other means well known in the art. The front end 14 additionally includes a grill 18 that also may be molded, painted or defined by other means well known in the art.

The frame 12 also includes an elongated hood portion 20 extending from the front end 14 rearwardly to a windshield 22. The windshield 22 is positioned between the hood 20 and a top 24 that extends downwardly to a rear end 26 of the frame 12. The frame 12 includes sides 28 that define wheel wells 30 and, if desired, fenders 32 extending partially around the wheel wells 30. The frame 12 also includes a bottom wall 27.

Figure 2:
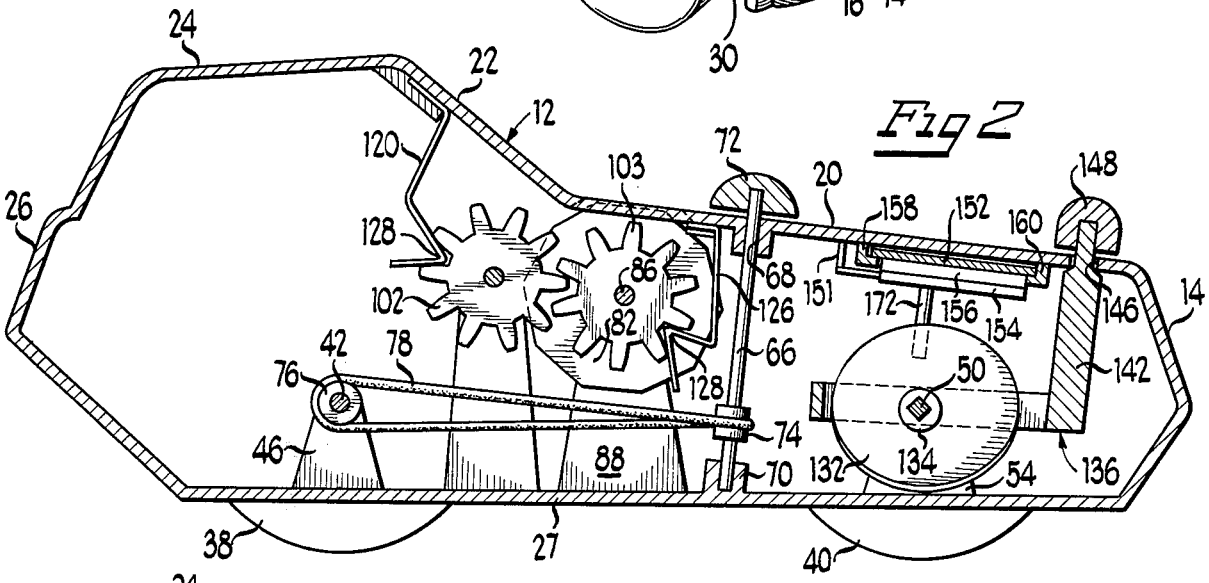
FIG. 2 is a vertical cross-sectional view of the toy vehicle taken along line 2—2 of FIG. 1.
Figure 3:
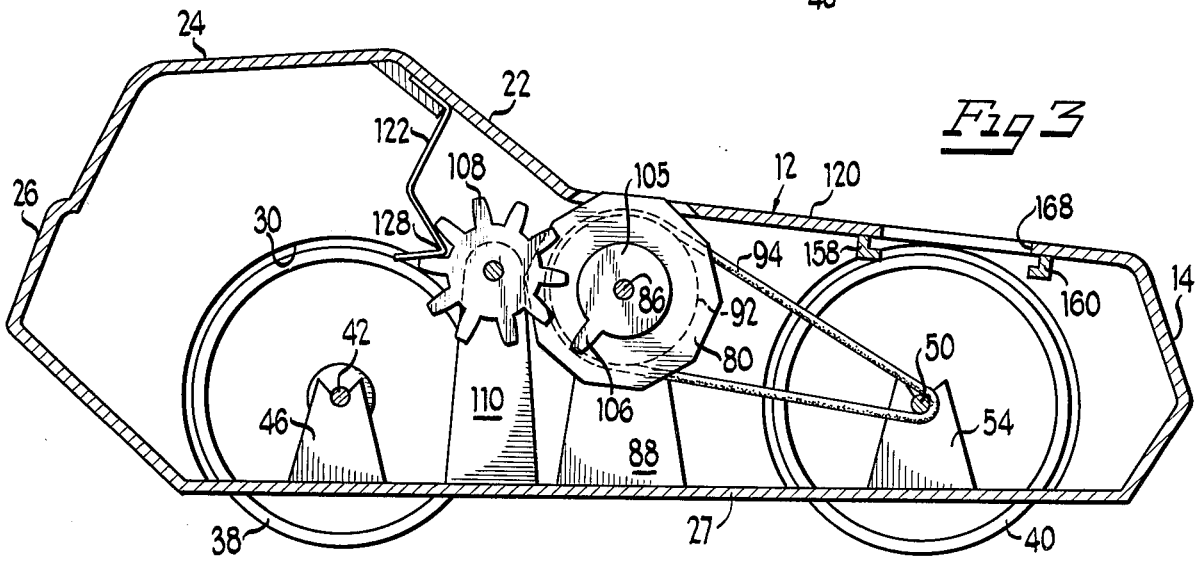
FIG. 3 is a vertical cross-sectional view of the toy vehicle taken along line 3—3 of FIG. 1.
Figure 4:
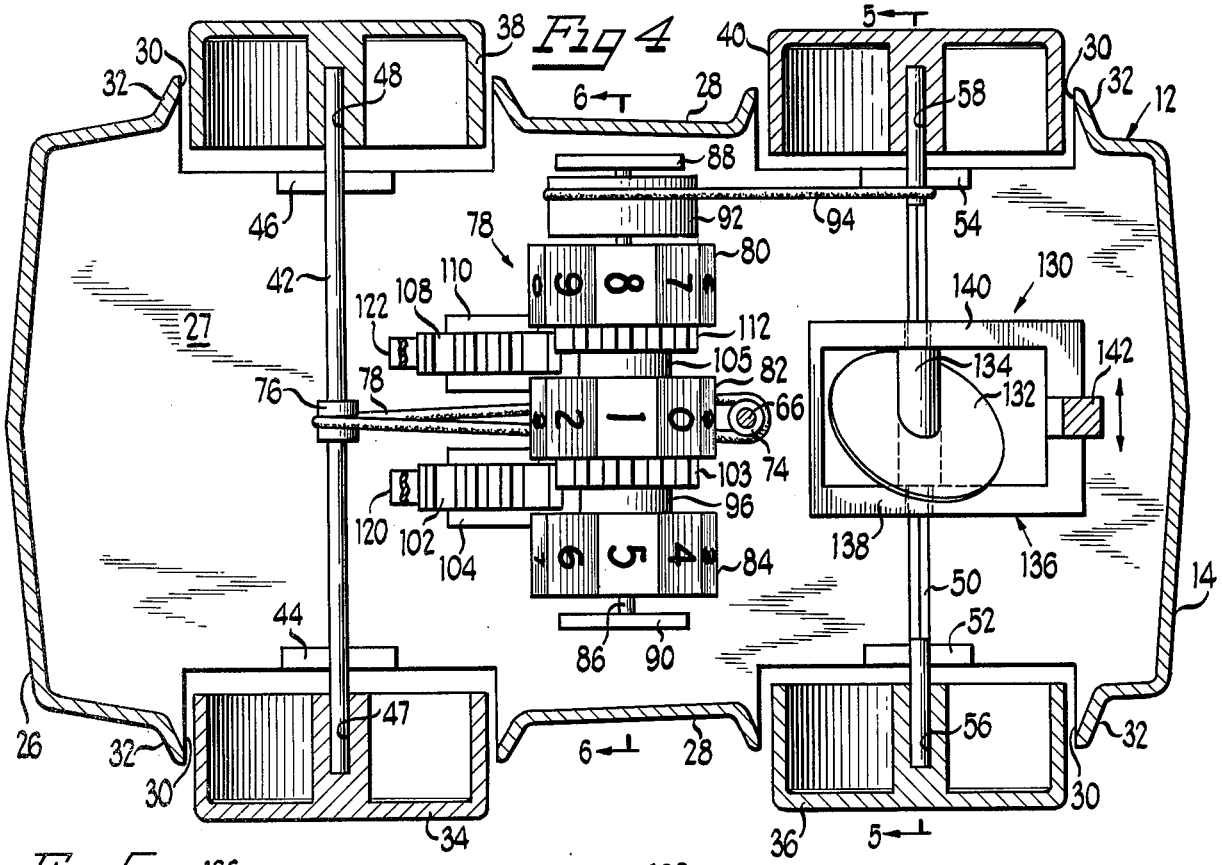
FIG. 4 is a horizontal cross-sectional view taken along line 4—4 of FIG. 1.

As best illustrated in FIGS. 2, 3 and 4, four wheels 34, 36, 38 and 40 are rotatably mounted on the frame 12 to support the frame 12 above a surface such as a floor over which the toy vehicle 10 travels. More specifically, the rear wheels 34 and 38 are mounted on a rear axle 42 that is snap fit into slotted axle supports 44 and 46 integrally defined on the bottom wall 27 of the frame 12. The ends of the axle 42 extend into apertures 47 and 48 defined in the wheels 34 and 38, respectively. In a similar fashion, the front wheels 36 and 40 are mounted on a front axle 50 that is secured to the frame by slotted support members 52 and 54 also integrally defined on the bottom 27 of the frame 12. The axle 50 extends into apertures 56 and 58 defined in the front wheels 36 and 40, respectively.

As can be understood from the description above, the toy vehicle 10 includes four wheels that are easily mounted onto the frame 12 by a rear axle 42 and a front axle 50 to allow the toy vehicle 10 to travel over a surface. An additional and important feature of the toy vehicle 10 is a fanciful speed indicating device similar to a speedometer, generally designated by the reference numeral 60. The speedometer 60 includes a dial or face plate 62 on the top of the hood 20 on which indicia 64 is defined in the form of numbers similar to that found on the speedometer of an automobile. The indicia 64 is placed on the surface of plate 62 in a semicircle about an axial point defined by a rod 66 extending through an aperture 68 in the hood 20. One end of the rod 66 extends into a rod support 70 defined in the bottom wall 27 of the frame 12 with the other end of the rod 66 extending through the aperture and above the hood 20. A pointer 72 is secured on the end of the rod 66 extending above the hood 20 and functions in a manner similar to the pointer in a speedometer of an automobile.

In order to couple the movement of the pointer 72 to the travel of the toy vehicle 10 so as to indicate in a fanciful manner the speed of the toy vehicle 10, the rod 66 includes a pulley 74 secured thereto. In addition, the rear axle 42 includes a similar pulley 76 secured thereto. A rubberband 78 or similar device extends between and is wrapped around the pulleys 76 and 74 and frictionally engage each in a manner such that rotation of the axle 42 is transmitted to the rod 66 as the toy vehicle 10 is pushed across a surface. The rotation of the rear wheels 34 and 38 imparts rotation to the rear axle 42 and this rotation is transmitted to the rod 66 turning the pointer 72 in a clockwise direction upon forward motion of the toy vehicle 10 thus indicating a speed in a fanciful manner. A ratchet mechanism or biasing means may be provided to cause the pointer 72 to stay at the highest speed achieved until it is manually reset to 0.

Another important feature of the toy vehicle 10 is a distance indicator or an odometer, generally designated by the reference numeral 78. The odometer 78, in the preferred embodiment illustrated includes three numeral indicator wheels 80, 82 and 84 that are mounted on an axle 86 rotatably secured at both ends by supports 88 and 90 that are mounted to the bottom wall 27 of the frame 12. Each numbered wheel 80, 82 and 84 includes ten flat surfaces each including one of the indicia 0–9. The wheel 84 is rigidly secured to the axle 86 and the axle 86 is mechanically coupled to the front axle 50 by way of a pulley 92 mounted on the axle 86 and a rubberband 94 wrapped around the pulley 92 and the axle 50 and extending therebetween. As can be understood, rotation of the front wheels 36 and 40 impart rotation to the axle 50 that in turn imparts rotation to the pulley 92. The indicia wheel 84 indicates, in a fanciful way, the units of distance traveled by the toy vehicle 10.

Secured to the indicia wheel 84 is a one tooth gear 96. The gear 96 includes a single tooth or lobe 100 generally adjacent to the surface of the wheel 84 on which the indicia 0 appears. The tooth 100 on the gear 96 engages an idler spur gear 102 mounted on a support 104 secured to the bottom 27 of the frame 12. The idler gear 102 is rotated by the tooth 100 the advancement of one tooth or surface in response to each complete revolution of the indicia numeral wheel 84. This rotation of the idler gear 102 imparts rotation to the wheel 82 through the spur gear 103 secured thereto. Secured to the wheel 82 on the opposite side of the gear 103 is another gear 105 that includes a single tooth 106 that engages another idler gear 108 mounted on a support 110 defined on the bottom wall 27 of the frame 12. Consequently, upon one complete revolution of the wheel 82, the single tooth 106 of the spur gear 105 engages and meshes with the spur gear 108 rotating the spur gear 108 the distance of one tooth. This rotation is imparted to the spur gear 112 secured to the wheel 80 rotating the wheel 80 one surface or one numeral.

Accordingly, the numeral wheel 84 corresponds to the single units of distance traveled, the wheel 82 corresponds to tens of units of the distance traveled, and the wheel 80 corresponds to the hundreds of units traveled by the toy vehicle 10.

As illustrated in FIG. 1, the upper surface of the wheels 80, 82 and 84 are adjacent windows or openings 114, 116 and 118, respectively, in the hood 20 thereby allowing the child operating the toy vehicle 10 to read the odometer 78 and determine the distance traveled.

In addition to the visual recordation of distance traveled by the odometer 78, a sounding means is incorporated through the employment of the springs 120, 122, 124 and 126 that engage the gears 96, 102, 105 and 108 to provide a sound upon the rotation of the gears. More specifically, each of the springs 120, 122, 124 and 126 include a bend in a manner to define an apex 128 that is intended to locate between the teeth of the gears 102, 103, 108 and 112 so that upon rotation of the gears 102, 103, 108 and 112, each spring 120, 122, 124 and 126 is pivoted outwardly to allow the apex 128 to pass over the end of each tooth and snap back into the adjacent space between the teeth providing a clicking sound thereby indicating advancement of each individual wheel 80, 82 and 84 and providing a detent mechanism for the wheels.

Another important feature of the present invention is a device, generally designated by the reference numeral 130, for signalling a turn of the toy vehicle 10. More specifically, the signal device 130 includes a disc 132 rigidly mounted on the front axle 50 between the sides of an open rectangular frame generally designated by the reference numeral 136. The frame 136 includes side walls 138 and 140 engaging the ends of the bearing 134. The bearing 134 and the walls 138 and 140 are slidably mounted on the axle 50. The frame 136 includes an upwardly extending handle 142 that extends through a slot 146 defined in the hood 20 of the frame 12. The handle 142 includes a knob 148 at the upper end thereof that may be grasped by a child to move the handle laterally within the slot 146 thus moving the frame 136 and the disc 132 laterally on the front axle 50.

Figure 5:
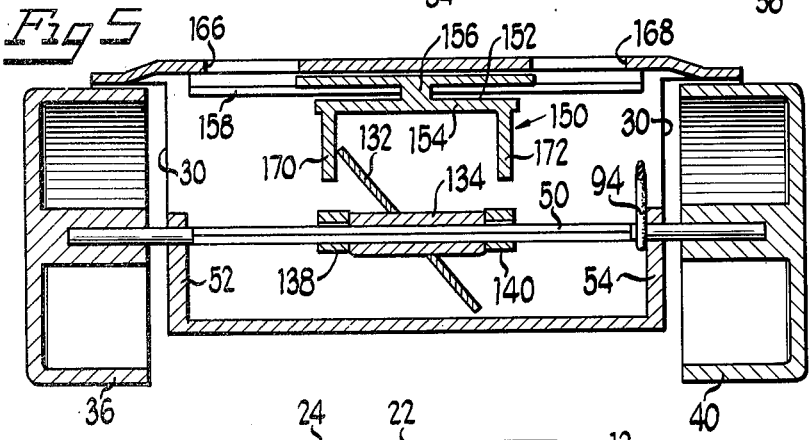
FIG. 5 is a vertical cross-sectional view of the toy vehicle taken along line 5—5 of FIG. 4.
Figure 7:
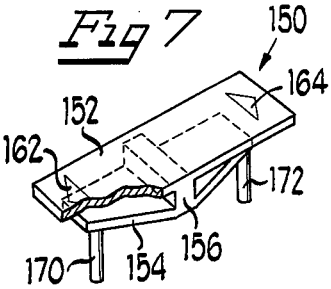
FIG. 7 is an enlarged perspective view of a portion of the turn signal mechanism of the toy vehicle.
Figure 6:
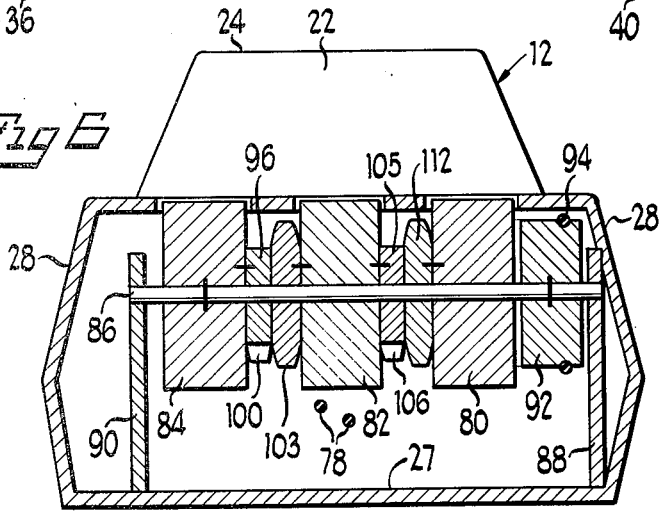
FIG. 6 is a vertical cross-sectional view taken along line 6—6 of FIG. 4 specifically illustrating the distance measuring device.

The disc 132 engages a signal element generally designated by the reference numeral 150 that includes an upper plate 152 and a lower plate 154 connected together and spaced from each other by a central rib 156. The signal element 150 is biased by a spring or other biasing means 151 to the center position as shown in FIG. 5. Upper plate 152 is positioned within two angle members 158 and 160 defined on the inner peripheral surface of the hood 20 that engage and hold the upper plate 152 of the signal element 150. At opposite ends of the upper plate 152 on the upper periphery thereof are colored triangular signal indicia 162 and 164 that are positionable beneath slots 166 and 168 defined on the hood 20 to signal the direction of a turn.

The lower plate 154 includes dowels or legs 170 and 172 extending downwardly therefrom to engage the rim of the disc 132. Accordingly, as best illustrated in FIG. 5, to signal a turn of the toy vehicle 10, a child may grasp the knob 148 moving it in a preferred direction in the slot 146. This transverse movement of the knob 148 moves the frame 136 and thus the disc 132 on the square axle 50. In a similar manner, through engagement of the disc 132 with one of the legs 170 and 172, the signal member 150 is also moved laterally relative to the hood 20 to a position locating one of the triangular signals 162 or 164 in the corresponding slot 166 or 168, respectively against the face of the centering spring 151. Thereafter, as the toy vehicle 10 is moved across a surface, the disc 132 rotates, and due to its angular position on the square shaft 50, the rim of the disc 132 is rotated to engage one of the legs 170 or 172 of the signal member 150. This action results in alternately moving the signal 160 or 164 into and out of the respective slot 166 or 168 against the face of the centering spring thereby providing a flashing signal effect similar to that found on the turn signals of automobiles. This flashing signalling effect continues until the knob 148 is grasped by the child and moved to its central position. The handle 142 is held in the right or left position by detent means such as the nibs 143 (FIG. 1).

As described above, the toy vehicle 10 provides a child playing with the toy vehicle 10 a realistic appearing toy with many of the features found in automobiles. Specifically, the toy vehicle 10 not only travels over a surface, such as a floor, but also indicates distance traveled, the speed at which the vehicle is travelling and may also flash a signal similar to a turn signal.

Many modifications and variations of the present invention are possible in light of the above teachings. Thus, it is to be understood that, within the scope of the appended claims, the invention may be practiced other than as specifically described above.

We claim:

1. A toy vehicle such as an automobile or the like, comprising:

a vehicle frame;

a plurality of wheels rotatably mounted on said frame to allow said vehicle to travel over a surface; and an automatically flashing turn signal device including a plate member slidably mounted on said body, indicia on said plate member indicating a signal, and means for repeatedly moving said plate to a signaling position including a disc coupled to at least one of said wheels and mounted at an angle to a longitudinal axis of said body and a spring biasing said plate member to a nonsignaling position.

2. The toy vehicle claimed in claim 1 further including a speedometer, said speedometer including a dial with indicia thereon, a pointer pivotally mounted in said dial, and means for transferring the rotation of said wheels to said pointer.

3. The toy vehicle claimed in claim 2 wherein said transferring means includes an elastic loop coupled to at least one of said wheels and said pointer.

4. The toy vehicle claimed in claim 1 further comprising means for indicating the distance traveled by said vehicle over said surface, said distance indicating means including at least one indicator wheel rotatably mounted in said body, said indicator wheel including a plurality of surfaces with indicia thereon, and means coupling at least one of said wheels to said indicator wheel.

5. The toy vehicle claimed in claim 4 wherein said coupling means comprises an elastic loop coupled to at least one of said wheels and said indicator wheel.

6. The toy vehicle claimed in claim 5 further comprising means for producing a sound upon rotation of said indicator wheel.

7. A toy vehicle comprising:

a vehicle frame;

means for rollably supporting said frame for travel across a suitable surface;

recording means coupled to said supporting means for measuring the distance traveled by said vehicle across said surface; and signaling means for indicating a right or left direction said signaling means including an engagement member slideably mounted on said rollably supporting means at an angle to the longitudinal axis of said frame, a signal element slideably mounted on said frame and surrounding said engagement member to be engaged and moved thereby, said signal element including means for signaling a turn upon movement of said signal element to a signaling position, biasing means for biasing said signal element to a nonsignaling position.

8. The toy vehicle claimed in claim 7 further comprising means for indicating the speed of said vehicle across said surface.

9. The toy vehicle claimed in claim 7 including sounding means for producing an audible signal as said vehicle travels across said surface.

10. The toy vehicle claimed in claim 7 further comprising means for deactuating said direction signaling means upon travel of said vehicle a predetermined distance over said surface.

11. The toy vehicle claimed in claim 7 or 8 further comprising means for manually actuating said direction signaling means.

* * * * *